United States Patent [19]

Bubik et al.

[11] 4,381,219

[45] Apr. 26, 1983

[54] HEADBOX ARRANGEMENT FOR A PAPERMAKING MACHINE

[75] Inventors: Alfred Bubik; Werner Seider, both of Ravensburg; Josef Hefter, Fenken, all of Fed. Rep. of Germany

[73] Assignee: Escher Wyss GmbH, Ravensburg, Fed. Rep. of Germany

[21] Appl. No.: 368,909

[22] Filed: Apr. 16, 1682

[30] Foreign Application Priority Data

May 14, 1981 [CH] Switzerland ..... 3137/81

[51] Int. Cl.[3] ..... D21F 1/02; D21F 11/04

[52] U.S. Cl. ..... 162/299; 162/301; 162/343

[58] Field of Search ..... 162/123, 132, 203, 216, 162/298, 299, 300, 301, 343, 347

[56] References Cited

U.S. PATENT DOCUMENTS 3,598,696 8/1971 Beck ..... 162/298
3,923,593 12/1975 Verseput ..... 162/343 X
4,089,739 5/1978 Hildebrand et al. ..... 162/343
4,125,429 11/1978 Hergert et al. ..... 162/123
4,141,788 2/1979 Justus ..... 162/132 X
4,181,568 1/1980 Pfaler ..... 162/343
4,198,270 4/1980 Kurtz et al. ..... 162/216 X

FOREIGN PATENT DOCUMENTS 899896 12/1953 Fed. Rep. of Germany .

*Primary Examiner*—Richard V. Fisher
*Attorney, Agent, or Firm*—Werner W. Kleeman

[57] ABSTRACT

A headbox arrangement for a papermaking machine contains a plurality of headboxes forming a group, these headboxes being arranged either essentially in parallelism with regard to one another or in fan-like or spread apart configuration. Between each two neighboring headboxes there is located a flexible divider, particularly in the form of a foil member, which extends past the outlet gap or slice of the headboxes.

9 Claims, 4 Drawing Figures

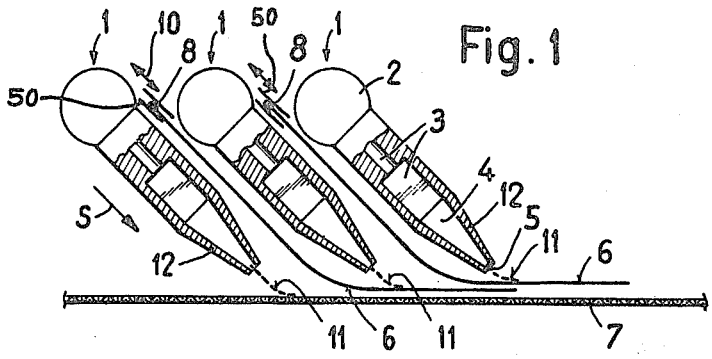
Fig. 1
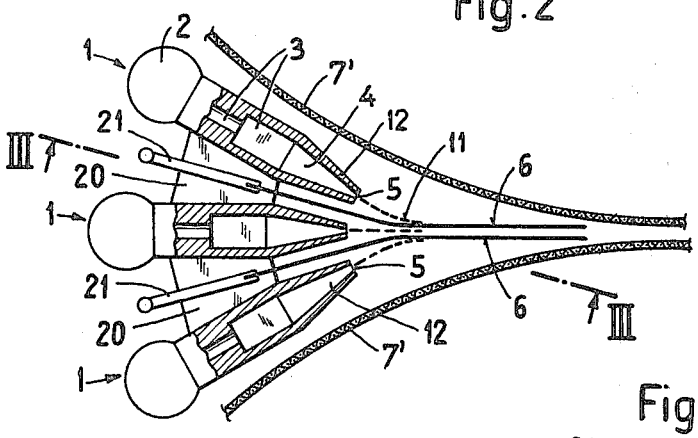
Fig. 2
Fig. 4
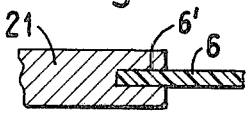
Fig. 3
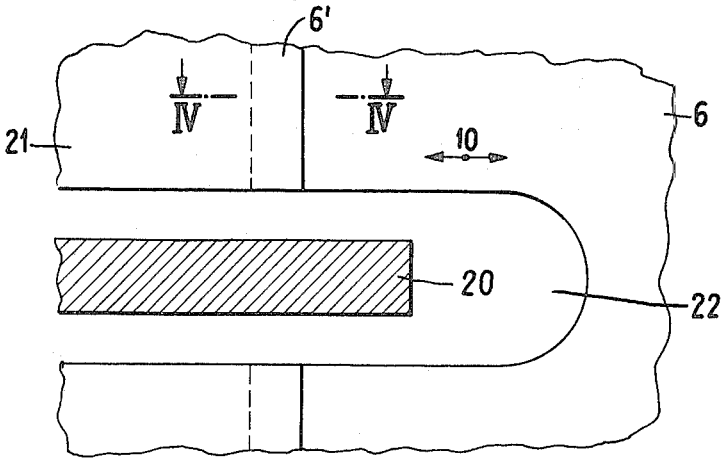

HEADBOX ARRANGEMENT FOR A PAPERMAKING MACHINE

BACKGROUND OF THE INVENTION

The present invention relates to a new and improved construction of a headbox arrangement for forming multi-ply paper webs upon a moving water pervious wire or forming web member or the like.

Headbox apparatuses for the formation of multi-ply paper webs are known, for instance, from German Pat. No. 899,896 and U.S. Pat. No. 3,923,593, granted Dec. 2, 1975 and U.S. Pat. No. 4,141,788, granted Feb. 27, 1979. In all these constructions of headboxes there is disclosed a headbox design, wherein the common nozzle channel which leads to the outlet slice, is subdivided into subpassages for the flow of different stock suspensions. With the headbox construction disclosed in German Pat. No. 899,896 there is provided as such flow divider facility a rigid, but adjustable tongue-like element; with the headbox construction of U.S. Pat. No. 3,923,593 there are provided flexible lamellae or plates for dividing the nozzle channel. With the headbox construction of U.S. Pat. No. 4,141,788 there are utilized flexible sheets which, in fact, extend past the outlet slice, so that there is obtained a separation of the individual stock jets until such time as they are deposited upon a forming wire.

With the headbox construction of U.S. Pat. No. 4,141,788 the aforementioned advantage is however acquired at the expense, that the flexible lamellae or sheets tend to adjust themselves within the nozzle channel of the headbox in such a manner that at both sides or faces thereof there prevails the same liquid pressure. This leads to the result that also the flow velocities at the regions of the nozzle channel at both sides of the lamellae or sheets are the same. Consequently, there are only afforded limited possibilities during the fabrication of different types of paper.

SUMMARY OF THE INVENTION

Therefore, with the foregoing in mind it is a primary object of the present invention to provide a new and improved construction of a headbox arrangement for a papermaking machine which is not afflicted with the aforementioned limitations and drawbacks of the prior art constructions.

Another and more specific object of the present invention aims at a new and improved construction of a headbox arrangement which allows with a compact structural arrangement the fabrication of multi-ply paper, and wherein, however, there is obtained extreme flexibility as concerns the infeed of the stock and the formation of the individual plies or layers.

A further significant object of the present invention is directed to a new and improved headbox arrangement for a papermaking machine, which is relatively simple in construction and design, extremely reliable in operation, not readily subject to breakdown or malfunction, and requires a minimum of maintenance and servicing.

Now in order to implement these and still further objects of the invention, which will become more readily apparent as the description proceeds, the headbox arrangement of the present development is manifested by the features that, there are provided at least two independent headboxes which form a group. Each of the headboxes of the group is provided with stock infeed means, typically a stock infeed line, a guide device, a nozzle channel and an outlet slice located at the end of the related nozzle channel. Between each two neighboring headboxes there is located a flexible divider, typically in the form of a flexible foil or sheet which extends past the outlet slice of the headboxes.

The subdivision of the headbox arrangement into independent headboxes having separate infeed lines, guide devices, their own nozzle channel and an outlet slice affords the freedom that, the flow quantities and flow velocities can be randomly adjusted within the individual plies or layers. This can be of advantage, for instance, where there are desired certain alignments of the fibers of the stock suspension in the individual layers or plies. By virtue of the provision of the flexible foils or sheets the plies or layers can be maintained separate from one another until they have been deposited upon a wire or between two wires, which particularly then is of importance where they separate from one another streams of the stock suspensions flowing at different velocities. The foil or sheet can be moveable at least in the flow direction of the stock suspension in the headboxes. By virtue of this foil mobility there is possible, for instance, an adjustment of the effective length of the foils or sheets. However, it is also conceivable to use oscillatory movements of the foils, by means of which there can be obtained different novel effects.

At least a part of the headboxes can be provided, in each instance, with at least one adjustable lip member for regulating the size of the outlet slice. By virtue of these measures there is obtained a further versatility in the operation of the system, namely the possibility of influencing the quantity of stock material within a stock stream or jet, apart from the possibility of also influencing the flow velocity by means of the flow cross-section.

According to one embodiment of the invention the headboxes can be arranged essentially parallel to one another and mutually offset with respect to one another. This embodiment is suitable, for instance, for longitudinal wire papermaking machines or twin-wire papermaking machines having a single wire region or section.

However, the headboxes also could be arranged in a fan-like or spread apart configuration. This constructional manifestation of the invention is suitable for twin-wire papermaking machines where the stock jets effluxing from the headboxes are directed into an inlet throat or wedge-like gap between both of the wires.

Preferably, the foil or sheet can be attached at its flow upstream end to a rigid, at least partially plate-shaped element. This plate-shaped element, which preferably can be fabricated from metal, ensures for a stable attachment and adjustability of the foil or the like, while affording an appreciably more simplified exchangeability thereof in the event of damage thereto, than was heretofore possible with the prior art constructions of headboxes.

The headboxes can be interconnected with one another by connection elements which are arranged in spaced relationship from one another. The foils or sheet members and the plate-shaped element are provided with recesses at the location of their connection elements, rendering possible their adjustability. Consequently, there is obtained a particularly compact construction of the headbox arrangement, which forms a unit or assembly.

BRIEF DESCRIPTION OF THE DRAWINGS

The invention will be better understood and objects others than those set forth above, will become apparent when consideration is given to the following detailed description thereof. Such description makes reference to the annexed drawings wherein:

FIG. 1 is a schematic sectional view of a first exemplary embodiment of headbox arrangement according to the invention;

FIG. 2 is a schematic sectional view of a second exemplary embodiment of headbox arrangement according to the invention;

FIG. 3 is a fragmentary sectional view of the arrangement of FIG. 2, taken essentially along the section line III—III thereof; and FIG. 4 is a fragmentary sectional view of the arrangement of FIG. 3, taken substantially along the section line IV—IV thereof.

DETAILED DESCRIPTION OF THE PREFERRED EMBODIMENTS

Describing now the drawings, it is to be understood that only enough of the construction of the headbox arrangement of the present development has been illustrated in the drawings in order to enable those skilled in the art to readily understand the underlying principles and concepts of the present invention, while simplifying the illustration of the drawings. Turning attention now specifically to FIG. 1, the headbox arrangement or system depicted therein will be seen to comprise, by way of example and not limitation, three headboxes 1. Each of these headboxes 1 is independently or individually equipped with a stock supply means 2, here shown in the form of a related stock feed line, a guide device 3 through which the stock suspension flows, and a nozzle channel 4 communicating with the guide device 3, this nozzle channel opening into an outlet slice or gap 5. Between each two neighboring headboxes 1 there is located a flexible divider 6, here in the form of a flexible foil or sheet member—herein usually simply referred to as a foil—which extends past the outlet slice or gap 5 of the neighboring headbox 1, as shown, and also extends along a suitable web-forming member, here shown as a wire 7 upon which there is formed, in this case, a triple-ply paper web by means of this headbox arrangement.

The foils or sheet members 6 are attached to suitably adjustable attachment elements 8, for instance rod-like attachment or connection elements, extending transversely with respect to the forming wire 7 and moveable in appropriate schematically indicated guides 50, so that the connection or attachment elements 8 along with the foils 6 can be selectively moved to-and-fro into a desired position in the direction of the double-headed arrow 10. Any suitable expedient can be used for this purpose apart from the rod-like connection or attachment elements 8 and the related guide tracks or guides 50 for permitting the selective adjustment and positioning of the foils 6. The movement of the foils 6 is accomplished essentially in the direction of flow of the stock suspension through the headboxes 1, and such flow direction has been merely generally indicated by the arrow S in FIG. 1.

During operation, liquid jets or streams 11 of the stock suspension efflux outwardly in conventional fashion through the outlet slices 5 of the nozzle channels 4, these stock jets being separated from one another by the divider foils 6. The length of these foils 6 can be selected or adjusted, as the case may be, in different fashion in compliance with the requirements prevailing during the fabrication of the paper. It should be understood that the foils or other equivalent divider members 6 have been shown in FIG. 1, for reasons of clarity in the illustration, somewhat further apart from one another than actually is the case during practical operation.

With the modified headbox arrangement or system depicted in FIG. 2 there have been generally conveniently used the same reference characters to denote the same or analogous components as were employed with the headbox arrangement of FIG. 1. In this case the headboxes 1 are arranged in a fan-like or spread apart configuration, and their liquid stock jets or streams 11 merge or converge towards one another. The headbox arrangement of FIG. 2 serves for the formation of a paper web at a twin-wire papermaking machine employing two wires 7'. With this headbox arrangement the headboxes 1 are interconnected by suitable connection elements 20, for instance in the form of brackets or straps, located in spaced relationship from one another, as shown. The flow upstream ends of the foil or sheet members 6, as best seen by referring to FIG. 4, are attached in a related slot or channel 6' of an associated plate-shaped connection or attachment element 21 which can be rigidly formed from a suitable metal. At the location of the connection elements 20, with the arrangement of FIG. 3, the foil 6 and the coacting plate-shaped element 21 are provided with a recess 22 enabling their adjustment in the direction of the double-headed arrow 10.

The nozzle channels 4 of the headboxes 1 are bounded by the lip members 12 which, in conventional fashion, can be adjustably constructed for regulating the size of the outlet gap or slice 5. The adjustment movement can be accomplished, for instance, by pivoting the lip members or by displacing the same in the direction of their plane towards the guide channel or device 3 or away from the same. It is even conceivable for each headbox 1 to only have one adjustable lip member 12, whereas the other lip member can be fixedly arranged. Under circumstances, at one of the headboxes or at all of the headboxes 1 it would be possible to dispense with any adjustability of the lip members. One possible construction of headbox employing adjustable lip members which can be used with the invention has been disclosed, by way of example and not limitation, in U.S. Pat. No. 4,089,739, granted May 16, 1978.

As already explained, the headboxes 1 according to the arrangement of FIG. 1, are oriented obliquely or at an inclination with respect to the forming wire 7, extend essentially parallel to one another and are offset from one another in the direction of movement of the multiple plies deposited upon the wire 7, in order to form a paper web at the wire 7 which extends essentially linearly. The wire 7 can be a longitudinal wire or a wire section of a twin-wire papermaking machine.

The flexible foils or sheet members 6 can be fabricated of any suitable yieldable or resilient material, such as for instance a plastic material or also from metal. The surface of the foil member 6 can be structured, in conventional fashion, so as to be smooth, roughened or have a different type of surface texture or structure.

While there are shown and described present preferred embodiments of the invention, it is to be distinctly understood that the invention is not limited thereto, but may be otherwise variously embodied and practiced within the scope of the following claims. Accordingly,

What we claim is:

1. A headbox arrangement for a papermaking machine for forming multi-ply paper webs upon a moved water impervious web forming member, comprising:

at least two independent headboxes forming a group;

each of said headboxes being provided with stock infeed means for a stock suspension, stock guide means, a nozzle channel and an outlet slice located at an end of said nozzle channel;

a flexible divider member located between each two neighboring headboxes; and said flexible divider member extending past the outlet slice of a neighboring headbox.

2. The headbox arrangement as defined in claim 1, wherein:

said flexible divider member comprises a flexible foil.

3. The headbox arrangement as defined in claim 2, further including:

means for moving each foil at least in direction of flow of the stock suspension through the headboxes.

4. The headbox arrangement as defined in claim 3, wherein:

at least part of the headboxes is equipped with at least one adjustable lip member for adjusting the size of the related outlet slice.

5. The headbox arrangement as defined in claim 1, wherein:

said headboxes are arranged essentially in parallellism with one another and offset relative to one another.

6. The headbox arrangement as defined in claim 1, wherein:

said headboxes are arranged in a substantially fan-like configuration.

7. The headbox arrangement as defined in claim 3, wherein:

said means for moving each of said foils comprises a substantially rigid, at least partially plate-shaped element at which there is attached the related foil at an upstream situated end thereof.

8. The headbox arrangement as defined in claim 7, further including:

connection elements arranged in spaced relationship from one another and serving to interconnect said headboxes with one another; and at least the foils being provided with recess means at the location of the connection elements for enabling adjustment of said foils.

9. The headbox arrangement as defined in claim 7, further including:

connection elements arranged in spaced relationship from one another and serving to interconnect said headboxes with one another; and at least the plate-shaped elements being provided with recess means at the location of the connection elements for enabling adjustment thereof.

* * * * *